United States Patent [19]

Forsyth

[11] Patent Number: 4,629,591

[45] Date of Patent: Dec. 16, 1986

[54] GAS DIFFUSER AND ACCOMPANYING PIPING SYSTEM

[75] Inventor: Robert H. Forsyth, Englewood, Colo.

[73] Assignee: A. R. Wilfley & Sons, Inc., Englewood, Colo.

[21] Appl. No.: 763,621

[22] Filed: Aug. 8, 1985

Related U.S. Application Data

[63] Continuation-in-part of Ser. No. 638,776, Aug. 8, 1984, abandoned.

[51] Int. Cl.[4] ..... B01F 3/04

[52] U.S. Cl. ..... 261/122; 137/590

[58] Field of Search ..... 261/122; 137/590, 152

[56] References Cited

U.S. PATENT DOCUMENTS

| | | | |
|---|---|---|---|
| 1,432,259 | 10/1922 | Richards | 137/590 |
| 1,543,280 | 6/1925 | Darragh | 137/152 |
| 1,566,753 | 12/1925 | Kraetch | 137/152 |
| 2,174,354 | 9/1939 | Shields | 137/590 |
| 3,009,261 | 11/1961 | Hieronymus | 137/590 |
| 3,041,841 | 7/1963 | Henry | 137/590 |
| 3,332,435 | 7/1967 | Anderson et al. | 137/590 |
| 3,997,634 | 12/1976 | Downs | 261/122 |
| 4,012,470 | 3/1977 | Thayer | 261/122 |
| 4,219,047 | 8/1980 | Polley | 137/590 |
| 4,237,928 | 12/1980 | Messersmith | 137/590 |

FOREIGN PATENT DOCUMENTS

| | | | |
|---|---|---|---|
| 348125 | 9/1960 | Switzerland | 261/122 |
| 2059791 | 4/1981 | United Kingdom | 261/122 |

*Primary Examiner*—Tim Miles

*Attorney, Agent, or Firm*—Clement and Ryan

[57] ABSTRACT

A plurality of gas diffusers and accompanying piping system which includes lengths of supply pipe for introducing gas into a body of liquid in which the apparatus is submerged. A combination gas diffuser inlet tube and supply pipe drainer stem is incorporated into the piping system between each length of supply pipe and each gas diffuser located above the length of supply pipe. The inlet tube/drainer stem extends downward from the plenum into the supply pipe to a location closely adjacent to, but with at least part of the bottom end of the combination member spaced from, the bottom wall of the supply pipe. As the pipe is pressurized with gas, gas fills the top portion of the pipe and unwanted accumulated liquid is forced down in the supply pipe, up through each drainer stem, and out the porous plate of the associated gas diffuser. The inlet tube/drainer stem (1) provides an outlet for unwanted accumulated liquids when said diffuser and accompanying piping system are operated under normal operating pressures, and (2) is at all times the sole outlet from the gas supply pipe, in addition to the transverse openings at each end thereof, for either gases or liquids.

6 Claims, 6 Drawing Figures

FIG. 3
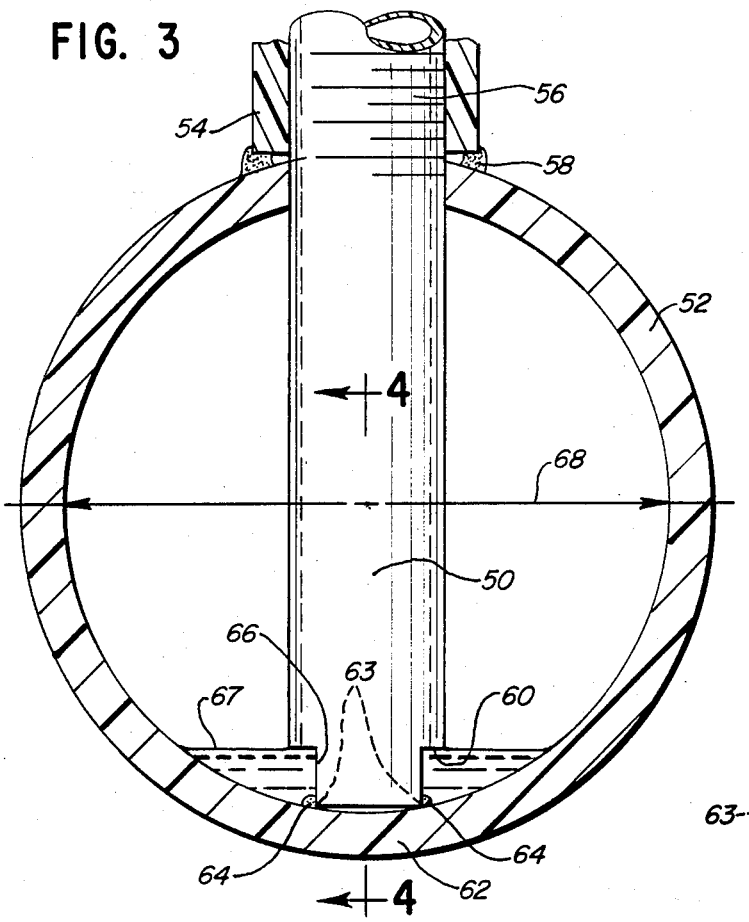
FIG. 4
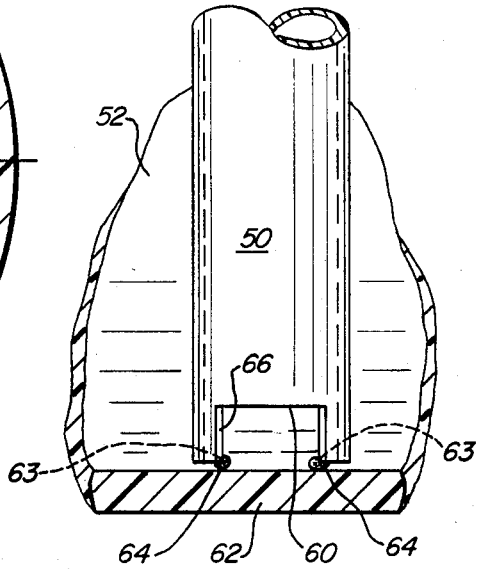
FIG. 5
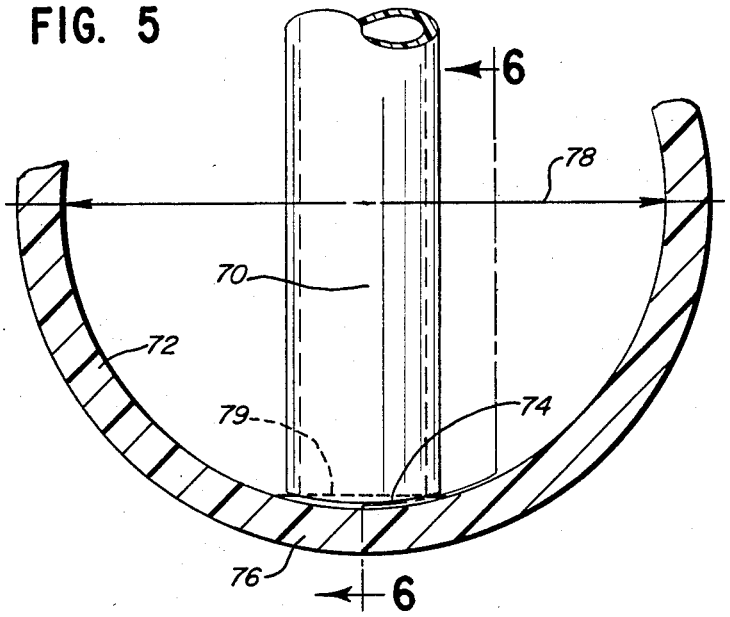
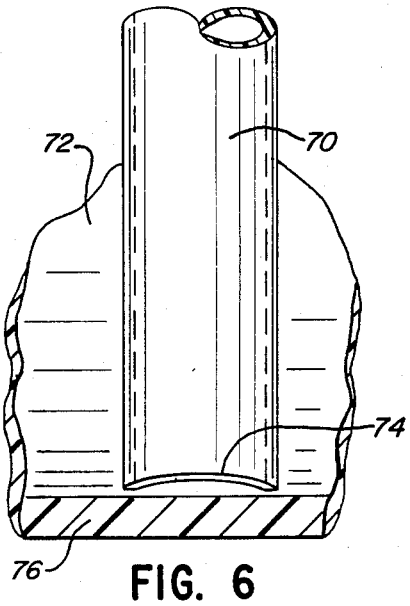
FIG. 6

GAS DIFFUSER AND ACCOMPANYING PIPING SYSTEM

Cross Reference to Related Application

This application is a continuation-in-part of my copending application Ser. No. 638,776 filed Aug. 8, 1984, now abandoned.

This invention relates to a gas diffuser and accompanying piping system for introducing gas into a body of liquid in which the diffuser and its piping system are submerged, and in particular such an apparatus that is self-draining.

BACKGROUND OF THE INVENTION

A series of passive gas diffusers and their accompanying piping system are frequently used to introduce air or other gases into a body of liquid in which they are submerged for oxygenation or other treatment of the liquid. Quite often a fairly large number of such gas diffusers is employed, with intervening pipes connecting the individual diffusers, and in such cases the entire system may extend for quite a distance. This is very often true when a natural body of water such as a small lake is being treated.

One of the problems with such diffusers and their accompanying piping systems is that when the diffusers are not in use the gas pressure falls within the gas plenums of the diffusers, and the liquid in which the diffusers are submerged flows into the supply pipes and diffusers.

In order to have gas introduced into the diffusers at the desired rate of flow, the supply pipes are commonly made with a rather large internal diameter to reduce pressure drop in the supply pipe. However, with conventional diffuser and piping systems optimum use is not made of the large diameter of such pipes. When a large part of the supply pipe remains filled with liquid following the shut-down during which liquid from outside the diffusers backs up in the system as just described, the effectiveness of the supply pipe is greatly reduced for the following reasons:

1. Gas flow in a pipe depends upon the cross-sectional area inside the pipe and the velocity of the gas in the pipe. Thus, for a given gas velocity the gas flow rate is reduced when the flow path area normal to the flow is reduced because of accumulated liquid in the pipes.

2. The pressure drop due to friction in the supply pipes for a given gas velocity depends upon pipe length and the pipe diameter. The pipe length is fixed upon installation. If the diameter available to gas flow decreases because liquid accumulates in the pipe, the pressure drop due to friction will increase.

3. The gas flow through a porous media gas diffuser is very sensitive to gas pressure in the plenum beneath the porous media, and a small change in the plenum gas pressure can effect a large change in the gas flow through the diffuser media. Thus an increase in the pressure drop in the gas supply pipe (such as referred to in paragraph 2 just above) can have a significant adverse effect on the gas flow rate through the diffuser.

These disadvantages are all present with conventional apparatus that is used to clear out unwanted accumulated liquid from the supply pipe for gas diffusers submerged in a liquid as described. In the conventional apparatus referred to, gas to be discharged from the diffusers flows into those diffusers from the top spaces in the supply pipe, and unwanted liquid is discharged either (1) from the bottom of the pipe or (2) out through a blowout assembly that extends upward through the top of the supply pipe to communicate with the atmosphere above the body of liquid being treated. The shortcomings of these two types of conventional apparatus will be seen from a discussion of the manner in which they operate.

The first device for the bottom draining of supply pipes just mentioned includes a spring-loaded ball float or other ball float or valve mechanism positioned at the bottom of the supply pipe, where it operates in conjunction with an opening in the bottom of the pipe through which liquid is forced out when the piping system is pressurized as the diffusers are started up. The ball float or other valve mechanism operates at an elevated pressure to produce liquid flow out of the supply pipes. Ordinarily there is only one such bottom draining opening in a gas supply pipe that extends for as much as 20 feet in length.

The blowout assembly commonly used to expel unwanted accumulated liquid comprises a kind of standpipe that extends from near the bottom of the gas supply pipe upward through the top of the supply pipe to communicate with the atmosphere above the body of liquid being treated. In usual practice, there may be only one of these blowout assemblies for a quite lengthy extent of gas supply pipe.

When gas is introduced at start-up into the supply pipe of either type of conventional system just described, after a certain pressure is reached in the space above the liquid in the supply pipes, gas flowing out the outlet at the top of the supply pipe into the gas plenum associated with the diffuser will pass from there out through the porous bubble-forming member. Consequently an extremely high (and thus expensive) gas pressure is required to produce a large enough gas flow to bring about the desired gas flow out of the diffusers and at the same time to maintain enough back pressure that unwanted accumulated liquid will be forced out the bottom of the supply pipe or out through the blowout assembly standpipe, as the case may be.

The high pressure required in each case just discussed will exceed the normal operating pressure for the gas diffuser by an additional pressure necessary to expel unwanted liquid against the hydrostatic pressure measured immediately outside and directly below the supply pipe in the case of bottom draining, or against the hydrostatic pressure measured at a level directly above the bottom wall of the gas supply pipe in the case of the described blowout assembly. This in turn will increase the gas flow rate out of the gas diffuser associated with the supply pipe to a value above the rate at which the diffuser is designed to operate, and this will result in an expensive waste of treating gas. (As used in this specification and claims, the term "normal operating pressure" of the gas diffuser is the pressure at which gas will pass out of the porous top wall of the diffuser in the volume required to maintain but not exceed the particular gas flow rate at which the diffuser is designed to operate.)

An additional disadvantage with conventional systems for removal of unwanted accumulated liquid results from the fact that with such systems, unless all the diffusers and their associated supply pipes are maintained within extremely close tolerances at exactly the same level within the body of liquid, the common level of accumulated liquid within the pipes may fill a considerably larger fraction of the pipes at some points in the series of diffusers than at others. Some of the individual diffusers will then operate at substantially lower efficiency than others. This problem is most acute in those instances mentioned above in which a large number of diffusers is employed and the resulting series of diffusers extends for quite a long distance.

The gas diffuser and piping system of the present invention avoids all these disadvantages.

SUMMARY OF THE INVENTION

The gas diffuser system of this invention, which is used with a source of pressurized gas, comprises:

a plurality of gas diffusers and associated piping systems, each of the diffusers and associated piping systems comprising:

(a) a conventional gas plenum having an inlet opening at its lower end for introduction of gas into the plenum;

(b) a porous member through which gas is forced out of the plenum at its upper end to produce bubbles in the body of liquid in which the diffuser is submerged;

(c) a length of liquid associated with the gas plenum, each such length of supply pipe being positioned below its associated plenum for connection in series with other similar lengths of pipe; and (d) a combination diffuser inlet tube and supply pipe drainer stem extending generally vertically downward from the gas plenum into the supply pipe to a location closely adjacent to the bottom wall of the supply pipe, with at least part of the bottom end of the combination diffuser inlet pipe and the supply pipe drainer stem being spaced from the supply pipe bottom wall;

means for interconnecting said lengths of supply pipe in said plurality of gas diffusers and associated gas supply pipes in series;

means for introducing pressurized gas from said gas source into the first length of gas supply pipe in said series, adjacent said inlet opening thereof; and closure means for said outlet end of the last length of gas supply pipe in said series.

One feature of this invention is that the greatest vertical distance between any point on the bottom end of the inlet tube/drainer stem and the bottom wall of the supply pipe is no more than about 10 percent of the inside diameter of the supply pipe. Improved results are obtained if the vertical distance just described is no more than about 5 percent of the inside diameter of the supply pipe, and best results are obtained when that distance is no more than about 1 percent of the supply pipe inside diameter.

A second feature of the invention is that the combination inlet tube and drainer stem (1) provides an outlet for unwanted accumulated liquid when said diffuser and accompanying piping system are operated under normal operating pressures, and (2)is at all times the sole outlet from the length of gas supply pipe, in addition to the transverse openings at each end thereof, for either gases or liquids.

In addition to the indicated features, the total cross-sectional area of the gap between the bottom end of the combination inlet tube/drainer stem and the bottom wall of the gas supply pipe is critical. The total cross-sectional area of the gap in queston must be large enough to accommodate a free flow from the supply pipe into the inlet tube/drainer stem of liquid having a predetermined viscosity, in order to permit accumulated liquid to be expelled from the supply pipe through the drainer stem and gas plenum and out the porous member of the plenum when gas is first introduced into the supply pipe. The total cross-sectional area of the gap must in addition be large enough to accommodate the flow of the gas that is to be dispersed from the diffuser into the body of liquid being treated from the supply pipe into the stem, and from there into the gas plenum and out the porous member of the plenum, at the desired gas flow rate at which the diffuser is designed to be used.

BRIEF DESCRIPTION OF THE DRAWING

This invention will be described by reference to the accompanying drawing, in which:

FIG. 3 is an end elevation of a second embodiment of the combination diffuser inlet tube and supply pipe drainer stem of the apparatus of this invention, with the gas supply pipe shown in transverse cross section;

FIG. 4 is a fragmentary side elevation of the combination diffuser inlet tube and supply pipe drainer stem of FIG. 3, with the gas supply pipe shown in longitudinal cross section along line 4—4 in FIG. 3;

FIG. 5 is an end elevation of a third embodiment of the combination diffuser inlet tube and supply pipe drainer stem of the apparatus of this invention, with a portion of the gas supply pipe shown in transverse cross section; and FIG. 6 is a fragmentary side elevation of the combination diffuser inlet tube and supply pipe drainer stem of FIG. 5, with the bottom portion of the gas supply pipe shown in longitudinal cross section along line 6—6 in FIG. 5.

DETAILED DESCRIPTION OF THREE EMBODIMENTS OF THIS INVENTION

The Structure Of The Device

First Embodiment

Figure 2:
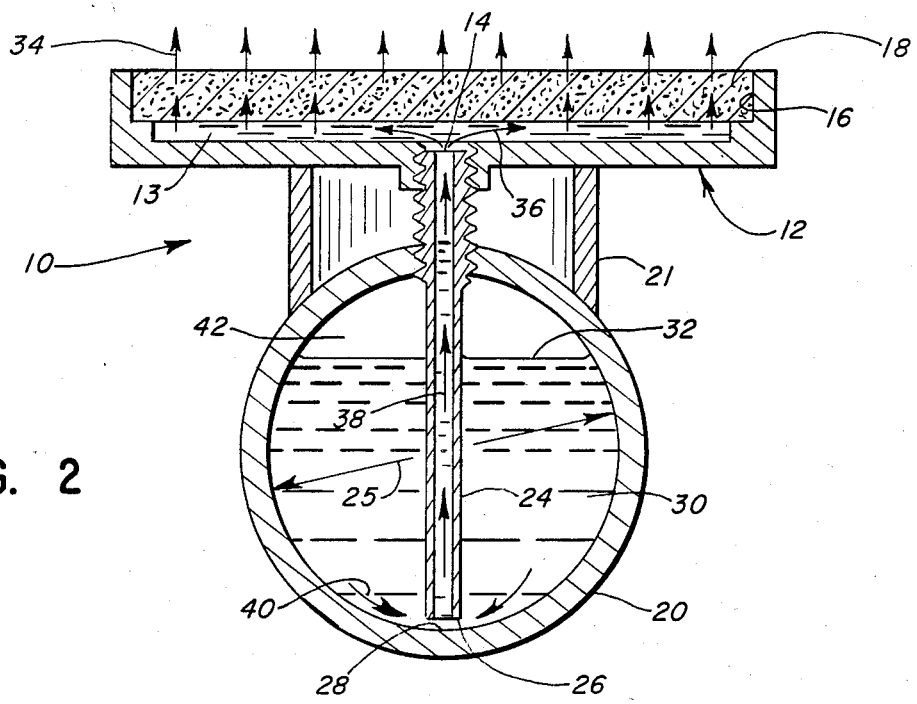
FIG. 2 is a sectional view taken along the line 2—2 in FIG. 1.
Figure 1:
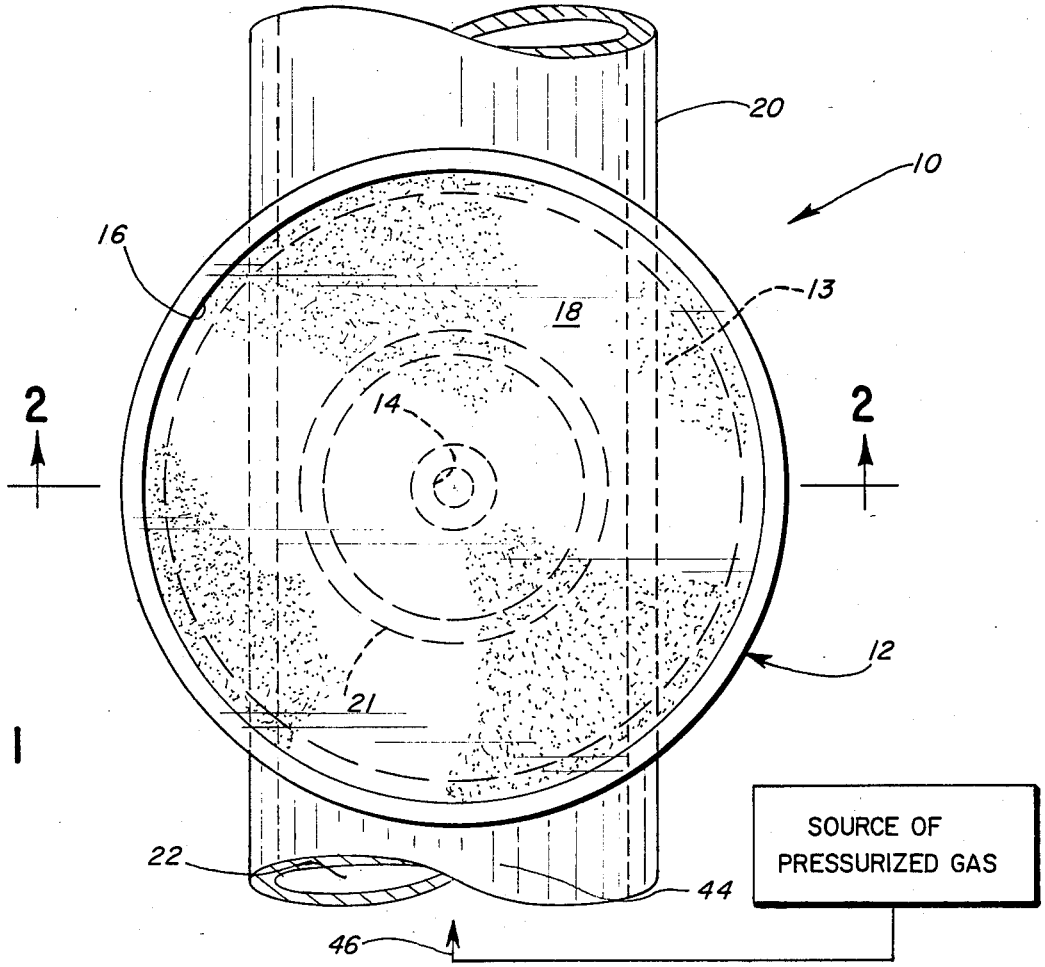
FIG. 1 is a plan view of a gas diffuser and a portion of a gas supply pipe comprising one embodiment of the apparatus of this invention.

In FIGS. 1 and 2, gas diffuser 10 includes diffuser body 12 enclosing a gas plenum 13. Diffuser body 12 has an inlet opening 14 at its lower end and a larger outlet opening 16 at its upper end. Porous member 18 closes outlet opening 16 with an airtight fit.

A length of gas supply pipe 20 is positioned below gas diffuser 10. Diffuser body 12 is supported on supply pipe 20 by diffuser saddle 21. In use, similar lengths of gas supply pipe 20, each with an associated gas diffuser 10, are connected together in series, with a plurality of adjacent lengths of supply pipe integrally formed with each other, and periodic joints between such pluralities of lengths 20. (Such joints may be, for example, PVC couplings secured with PVC cement, expansion joints or any other suitable type of connection.) The last length of gas supply pipe in the series terminates in a closure means.

The length of supply pipe shown in FIG. 1 has an inlet end 22 for introduction of gas to be piped to and into gas plenum 13. The remote end of another similar length of supply pipe 20 that is connected in series with the length of supply pipe 20 shown in this Figure is in turn connected to a source (not shown) of the gas that is to be diffused into the body of liquid being treated.

Combination diffuser inlet tube and supply pipe drainer stem 24 extends generally vertically downward from plenum inlet opening 14 into supply pipe 20 (FIG. 2). Its lower inlet end 26 extends to a location closely adjacent to but spaced from bottom wall 28 of the supply pipe. As seen in FIG. 2, the bottom end of inlet tube/drainer stem 24 terminates in a planar surface that lies in a substantially horizontal plane.

Member 24 has a dual function—introduction of gas into diffuser 10 and discharge of unwanted accumulated liquid from supply pipe 20—that will be explained below.

As pointed out above, there must be sufficient space—or, in other words, sufficient total cross-sectional area—in the gap between lower opening 26 of diffuser inlet tube/drainer stem 24 and supply pipe bottom wall 28 that liquid with a predetermined viscosity, i.e., the liquid into which gas will be dispersed by use of the diffuser and piping system of this invention, can flow freely from inside supply pipe 20 into the combination inlet tube and drainer stem. In addition, the total cross-sectional area of that gap must be large enough to accommodate the flow of gas from the supply pipe into the inlet tube/drainer stem, and from there into the gas plenum and out the porous member of the plenum, at the desired gas flow rate at which the diffuser is designed to be used.

As also indicated above, in addition to these spacing requirements, the greatest vertical distance between any point on the bottom end of inlet tube/drainer stem 24 and bottom wall 28 of supply pipe 20 is also of significance in this invention. Satisfactory results are obtained when the distance in question is no greater than about 10 percent of inside diameter 25 of supply pipe 20, improved results are obtained when that figure is no more than about 5 percent, and best results are obtained when that distance is no more than about 1 percent of the supply pipe inside diameter. The smaller this percentage figure is—so long as free flow of liquid is permitted—the more effective the device of this invention will be in clearing unwanted accumulated liquid out of the supply pipe.

Second Embodiment

FIG. 3 is an end elevation of a second embodiment of the combination gas diffuser inlet and supply pipe drainer stem 50 extending downward into supply pipe 52, which is shown in transverse cross section.

A part of collar 54 by which inlet tube/drainer stem 50 is connected with a gas diffuser located above is internally threaded to receive threaded upper end 56 of member 50. In this embodiment, members 50, 52 and 54 are all formed of polyvinyl chloride. Collar 54 is secured to supply pipe 52 with PVC cement to form airtight weld 58.

As seen in FIGS. 3 and 4, combination inlet pipe/drainer stem 50 is cut out at its bottom end to form two rectangular slots 60 on either side of member 50. FIG. 4 is a fragmentary showing of the bottom end of member 50, with supply pipe 52 being shown in longitudinal cross section taken along line 4—4 in FIG. 3.

The contact areas between inlet pipe/drainer stem 50 and bottom wall 62 of supply pipe 52 at the bottom corners 63 of slots 60 are bonded together permanently with PVC cement to form bonds 64. Part but not all of the bottom end of member 50 is thus permanently secured to bottom wall 62 of supply pipe 52. It will be understood that in FIG. 3 the corners 63 that are shown as bonded to bottom wall 62 of supply pipe 52 are at the rear of their respective slots 60, and in FIG. 4 are the two corners of the slot 60 that is in the rear of that Figure. If desired the entire bottom end of inlet pipe/drainer stem 50 between corners 63 in FIG. 3 may be bonded to bottom wall 62 of the gas supply pipe.

This permanent attachment helps to maintain the vertical alignment of inlet pipe/drainer stem 50 and the vertical spacing between the bottom end of member 50 and bottom wall 62 of supply pipe 52. The vertical alignment of inlet pipe/drainer stem 50 will in turn insure horizontal alignment of the flat upper surface of porous member of the gas diffuser that is mounted above member 50, which horizontal alignment is important for proper functioning of the diffuser.

It will be seen from FIG. 3 that in this form of the invention the greatest vertical distance between any point on the bottom end of member 50 and bottom wall 62 of supply pipe 52 is represented by vertical line 66 indicating the side wall that helps define slot 60. In this embodiment, distance 66 is about 10 percent of the inside diameter 68 of supply pipe 52. As shown, unwanted accumulated liquid will be expelled by use of inlet tube/drainer stem 50 to level 67.

Third Embodiment

FIG. 5 is a fragmentary end elevation of a third embodiment of a combination inlet tube/drainer stem 70 for use in this invention, together with a fragmentary transverse sectional view of supply pipe 72.

As seen in FIGS. 5 and 6, in this embodiment bottom end 74 of inlet tube/drainer stem 70 has a cylindrical shape so that is is uniformly spaced throughout from cylindrical bottom wall 76 of supply pipe 72. As a result, the greatest vertical distance between any point on bottom end 74 of member 70 and bottom wall 76 of supply pipe 72 is no more than about 1 percent of the inside diameter 78 of the supply pipe. In this embodiment, unwanted accumulated liquid is expelled to level 79.

Operation Of Gas Diffuser And Piping System Of This Invention

The operation of the gas diffuser and piping system of this invention will now be explained by reference to the first embodiment of the apparatus, which is illustrated in FIGS. 1 and 2.

By incorporating the combination gas diffuser inlet tube and supply pipe drainer stem into the piping system at a point between the diffuser and the supply pipe positioned below the diffuser, this invention takes advantage of the difference in density between a gas and a liquid to provide a simple structure for removal of unwanted liquid that has accumulated within the supply pipe during any period the system is shut down.

Because of the structure of the apparatus of this invention, as the supply pipe is pressurized with gas when the system is started up again after a shut-down, due to its lower density the gas fills the top portion of the pipe. As the gas takes up space in the top of the pipe, the liquid inside the pipe is displaced downward and forced up through the supply pipe drainer stem and out the diffuser. The liquid level in the supply pipe continues to drop until the pipe has drained down below the level of the bottom, or inlet end, of the drainer stem.

When the liquid level has drained below the bottom end of the drainer stem, gas can then flow again to the diffuser. The low pressure required for operation—any pressure above the static head of the liquid at about the level at which the bottom wall of the supply pipe is submerged—allows liquid to be forced out through the remaining diffusers in the system after gas has started to flow through some of the diffusers of the system.

These general principles of operation of this invention will now be illustrated by a more specific description of the manner of operation of the device of the invention.

As indicated above, when a gas diffuser system of the type disclosed is shut down and the gas pressure within the system falls below the pressure of the water or other liquid at the level to which the diffuser has been submerged, liquid will enter the diffuser system and will fill up a large part of the supply pipe. In FIG. 2, liquid 30 has backed up into supply pipe 20 to a level 32 located at a height approximately three-quarters of the internal diameter of the supply pipe above the bottom of the pipe.

Diffuser 10 and supply pipe 20, with the arrows indicating liquid flow, are shown in FIG. 2 in the condition they occupy just after the system is started up again after it has filled with unwanted liquid. In this Figure, the arrows show how the undesired liquid is being forced out of the system.

When the system was shut off, liquid flowed into gas plenum 13 through porous member 18 in a direction opposite to what is shown by arrows 34. Liquid then proceeded, in the direction opposite to arrows 36, 38 and 40, to fill up supply pipe 20 to level 32.

When liquid flowed into supply pipe 20 as just described, the accumulated liquid 30 pushed up against the volume of gas 42 that was trapped in the system when the flow of gas from the gas source was cut off at the inlet end of supply pipe 20. Liquid 30 continued to rise until an equilibrium was established between the pressure of the liquid at the depth in the body of liquid to which the diffuser and supply pipe are submerged on the one hand, and the pressure of the trapped gas 42 in the top portion of supply pipe 20 on the other.

With the system of the present invention, gas is fed from source of pressurized gas 43 into supply pipe 20 at its inlet end through the top wall of the pipe, such as wall 44 in the section of pipe 20 that is shown in FIG. 1. This gas proceeds in the direction of arrow 46.

As gas continues to be fed into supply pipe 20 in the manner described, it increases the pressure of the trapped gas in space 42, and forces accumulated liquid 30 downward in supply pipe 20. To push the accumulated liquid from level 32 to the level of inlet end 26 of the diffuser inlet tube and supply pipe drainer stem 24, gas must be introduced as just described until a gas pressure is produced that is just greater than the static pressure head of the liquid at the level of stem inlet end 26 shown in FIG. 2.

When the level of accumulated liquid 30 has been lowered to the point indicated, gas will enter drainer stem 24 in the manner indicated by arrows 40 and rise as indicated by arrows 38. When the gas reaches the upper end of stem 24, it will enter gas plenum 13 as indicated by arrows 36, and pass out through porous member 18 as indicated by arrows 34.

So long as sufficient gas pressure is maintained, gas will continue to exit from supply pipe 20, pass through gas diffuser inlet tube 24 into plenum 13, and pass out through porous member 18 into the body of liquid being treated. At this juncture, practically the entire available space within series-connected supply pipes 20 feeding all the diffusers 10 is filled with gas.

As will be seen, in the various structures according to this invention that are shown in the drawing and described above, the combination gas diffuser inlet tube and supply pipe drainer stem provides an outlet for unwanted accumulated liquid without elevating the pressure at which the device is operated above normal operating pressures for the diffuser and accompanying piping system. No other outlet is provided for either gases or liquids from the gas supply pipe (except for the transverse openings at each end thereof) in addition to the inlet tube/drainer stem itself, and thus wasteful discharge of gas through the bubble-producing wall of the gas diffuser plenum is avoided by eliminating the necessity of increasing the operating pressure of the piping system and gas plenum so as to drive unwanted accumulated liquid of the gas supply pipe when one accumulated liquid out of the conventional liquid-expelling devices of the prior art is used.

ADVANTAGES OF THE INVENTION

By utilizing the difference in density between a gas and a liquid, the gas diffuser and piping system of this invention achieve the following advantages:

1. The invention insures the efficient operation of all diffusers on a given pipe line, by making sure that the supply pipe is virtually fully drained whenever it is started up after having been shut down for a period.

2. This virtually complete draining is accomplished without any substantial increase being necessary in the pressure of the gas fed into the supply pipes and from there to the gas diffusers.

3. This apparatus permits all diffusers to flow at the designed flow rate.

4. With the apparatus of this invention, thorough draining of non-level supply pipes, which is not possible with many prior art systems, can be achieved.

5. With each start-up, every diffuser plate is back flushed and cleaned by the reverse flow of liquid therethrough.

6. Only foreign materials smaller than the foramina of the diffuser plates can enter the piping system.

This is to be contrasted with the situation in prior art systems that rely on ball floats or other valve mechanisms for drainage of unwanted liquid out the bottom wall of the supply pipe. In those systems, when the system is shut down the pressure from outside the system causes liquid to enter through the drainage openings and, since these openings are necessarily fairly large, foreign materials up to a size comparable to those fairly large openings that are suspended in the liquid can enter the system and cause clogging of the bottom side of the diffuser plate when operation is started up again.

7. For reasons explained above, the apparatus of this invention reduces the pressure losses in the piping system by allowing full pipe cross-section gas flow.

8. The apparatus of this invention is of simple and economical construction in comparison to the conventional systems employing a ball float or other valve mechanism of the prior art.

The above detailed description has been given for ease of understanding only. No unnecessary limitations should be understood therefrom, as modifications will be obvious to one skilled in the art.

I claim:

1. A combination of a plurality of gas diffusers and accompanying piping system for diffusing gas from a source of pressurized gas into a body of liquid in which said diffusers and piping system are submerged, which comprises:

a plurality of gas diffusers and associated piping systems, each of said diffusers and associated piping systems comprising:

(a) a chamber forming a gas plenum having an inlet opening at its lower end and a larger outlet opening at its upper end;

(b) a porous member closing the larger opening in said plenum;

(c) a length of gas supply pipe associated with said gas plenum, said length of pipe being positioned below said plenum for connection in series with other similar lengths of gas supply pipe, each of said lengths of supply pipe having a transverse opening at its inlet end for introduction of gas to be piped to and into its associated gas plenum and a transverse opening at its outlet end; and (d) a combination diffuser inlet tube and supply pipe drainer stem extending generally vertically downward from said inlet opening of the gas plenum into said supply pipe to a location closely adjacent to the bottom wall of said supply pipe, with at least part of the bottom end of the combination diffuser inlet tube and supply pipe drainer stem being spaced from said bottom wall, the greatest vertical distance between any point on the bottom end of said combination diffuser inlet tube and supply pipe drainer stem and said bottom wall of the gas supply pipe being no more than about 10 percent of the inside diameter of said supply pipe, the total cross-sectional area of the gap between said bottom end and said bottom wall being large enough (i) to accommodate the free flow from said supply pipe into said combination inlet tube and drainer stem of liquid having the predetermined viscosity of the body of liquid into which gas is to be dispersed by said diffuser, and (ii) to accommodate the flow of gas from said supply pipe into said drainer stem, and from there into said gas plenum and out its said porous member, at the desired gas flow rate at which said diffuser is designed to be used;

means for interconnecting in series said lengths of supply pipe in said plurality of gas diffusers and associated gas supply pipes;

means for introducing pressurized gas from said source into the first length of gas supply pipe in said series, adjacent said inlet opening thereof; and closure means for said outlet end of the last length of gas supply pipe in said series, said combination inlet tubes and drainer stems (i) providing an outlet for unwanted accumulated liquid when said diffusers and associated lengths of gas supply pipes are operated under normal operating pressure, and (ii) being at all times the sole outlet from said lengths of gas supply pipe, in addition to the transverse openings at each end thereof, for either gases or liquids, whereby unwanted accumulated liquid can be expelled from said lengths of supply pipe through said combination inlet tubes and drainer stems and out the porous members of said gas plenums when gas is first introduced into said lengths of supply pipe, and thereafter gas can flow from each length of supply pipe into its associated gas plenum and out through said porous members into the body of liquid being treated.

2. The gas diffuser and accompanying piping system of claim 1 in which the bottom end of said combination diffuser inlet tube and supply pipe drainer stem terminates in a planar surface lying in a substantially horizontal plane.

3. The gas diffuser and accompanying piping system of claim 1 in which the greatest vertical distance between any point on the bottom end of said combination diffuser inlet tube and supply pipe drainer stem and the bottom wall of said supply pipe is no more than about 5 percent of the inside diameter of said supply pipe.

4. The gas diffuser and accompanying piping system of claim 1 in which the greatest vertical distance between any point on the bottom end of said combination diffuser inlet tube and supply pipe drainer stem and the bottom wall of said supply pipe is no more than about 1 percent of the inside diameter of said supply pipe.

5. The gas diffuser and accompanying piping system of claim 1 in which a part but not all of the bottom end of the combination diffuser inlet tube and supply pipe drainer stem is permanently secured to the bottom wall of said supply pipe.

6. The gas diffuser and accompanying piping system of claim 1 in which a part but not all of the bottom end of the combination diffuser inlet tube and supply pipe drainer stem is permanently secured to the bottom wall of said supply pipe.

* * * * *